US005775837A

United States Patent [19]

Schneider

[11] Patent Number: 5,775,837

[45] Date of Patent: Jul. 7, 1998

[54] INFLATABLE PLUGS FOR INSTALLING EROSION CONTROL BLOCKS

[76] Inventor: Thomas W. Schneider, 3400 Stowers, Monroe, La. 71201

[21] Appl. No.: 675,706

[22] Filed: Jul. 3, 1996

[51] Int. Cl.[6] ..... E02B 3/12

[52] U.S. Cl. ..... 405/17; 405/16; 294/98.1

[58] Field of Search ..... 405/20, 17, 19, 405/16; 294/98.1, 119.3, 81.6

[56] References Cited

U.S. PATENT DOCUMENTS

| | | | |
|---|---|---|---|
| Re. 32,663 | 5/1988 | Atkinson et al. . | |
| 2,826,445 | 3/1958 | Tidland | 294/98.1 |
| 3,635,281 | 1/1972 | Comte et al. | 294/98.1 X |
| 3,780,492 | 12/1973 | Corderoy | 294/98.1 X |
| 3,892,437 | 7/1975 | Makinen | 294/98.1 |
| 4,201,494 | 5/1980 | Crowe | 405/17 |
| 4,227,829 | 10/1980 | Landry, Jr. et al. . | |
| 4,286,895 | 9/1981 | Poli et al. | 405/17 |
| 4,370,075 | 1/1983 | Scales . | |
| 4,372,705 | 2/1983 | Atkinson | 405/16 X |
| 4,474,504 | 10/1984 | Whitman . | |
| 4,783,108 | 11/1988 | Fukuyama et al. | 294/98.1 |
| 4,875,803 | 10/1989 | Scales et al. . | |
| 4,906,130 | 3/1990 | Manley et al. | 405/17 X |
| 5,484,230 | 1/1996 | Rudloff . | |

FOREIGN PATENT DOCUMENTS

| | | | |
|---|---|---|---|
| 2141107 | 8/1971 | Germany . | |
| 59-0224710 | 12/1984 | Japan | 405/20 |
| 59-0224711 | 12/1984 | Japan | 405/20 |
| 2025494 | 1/1980 | United Kingdom . | |

OTHER PUBLICATIONS

CHERNE Industries Incorporated; Plumbing and Municipal Products; copyrighted 1994: distributed by CLS Service and Supply Company; a product brochure.

CHERNE Industries Incorporated; Largest variety of Pipe Plugs; copyrighted in 1992; distributed by CLS Service and Supply Company; a product brochure.

*Primary Examiner*—Dennis L. Taylor

*Attorney, Agent, or Firm*—Sidley & Austin

[57] ABSTRACT

An erosion control block having a bore formed therein for engaging with an inflatable plug. The inflatable plugs of plural blocks are cabled together so as to engage a matrix of blocks, and when inflated, the plugs allow the cable to lift the entire matrix of blocks. The matrix of erosion control blocks can be lifted by a crane and installed by the utilization of the cabling system having inflatable plugs attached to the cabling and engagable within central bores formed within each block. The inflatable plugs can be deflated and removed with the cabling from the installed matrix of blocks, and reused.

18 Claims, 12 Drawing Sheets

FIG. 9
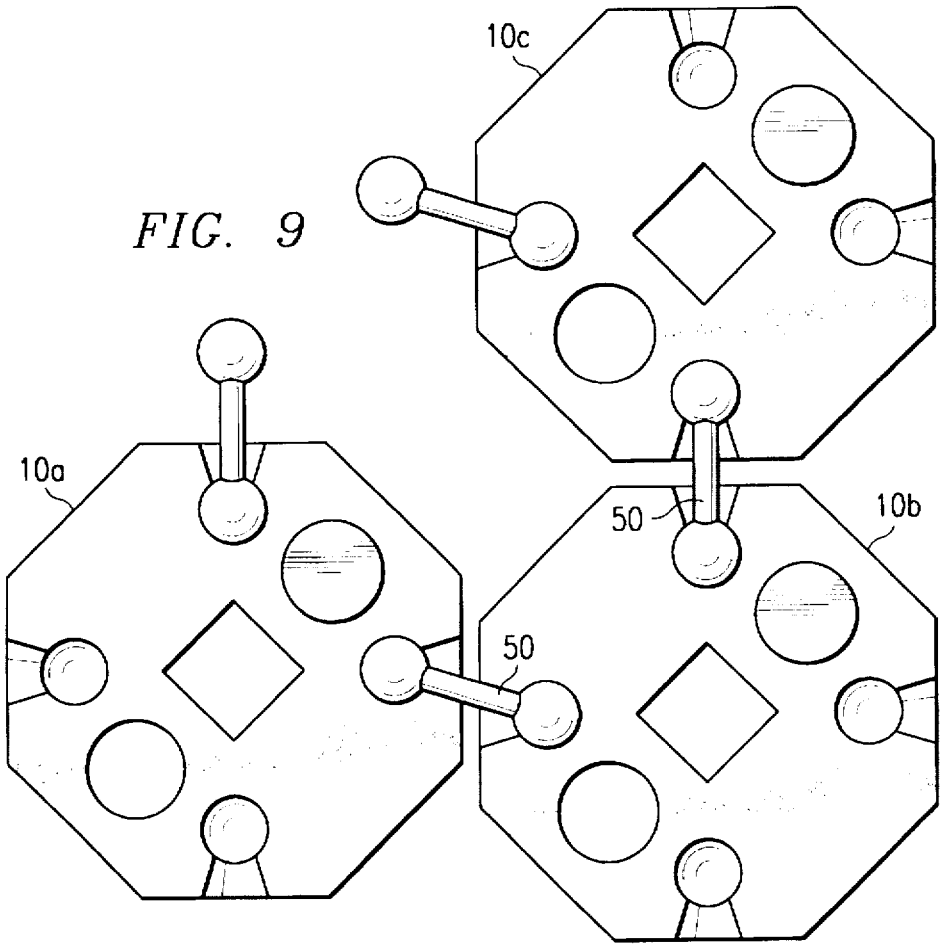
FIG. 10
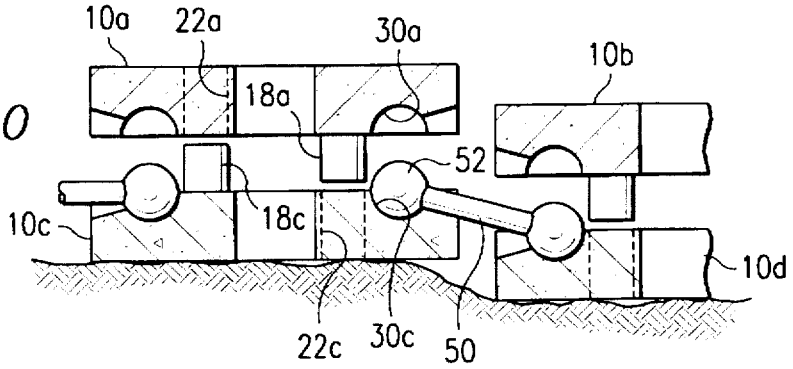
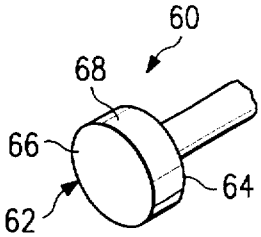
FIG. 14
FIG. 15
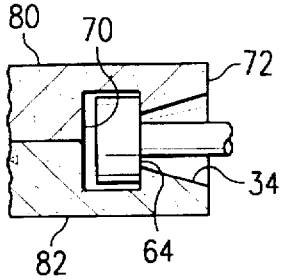

FIG. 16
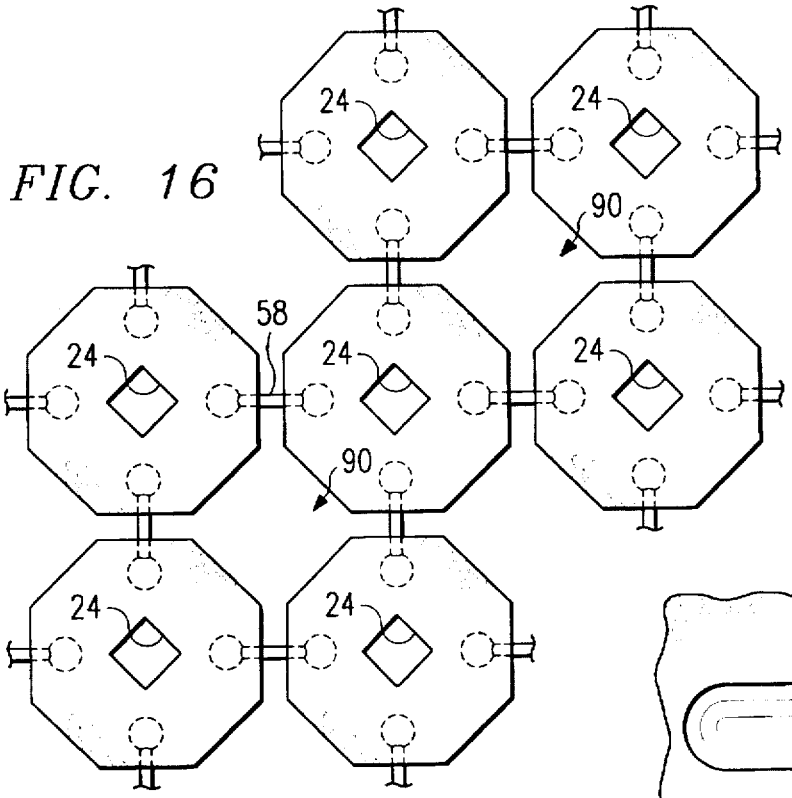
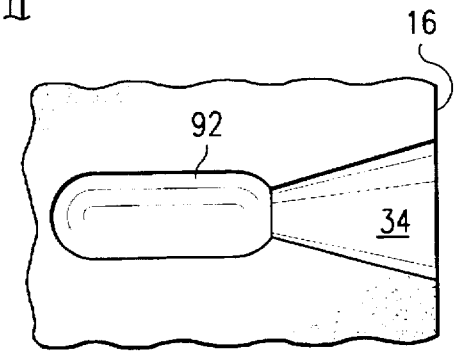
FIG. 17
FIG. 18
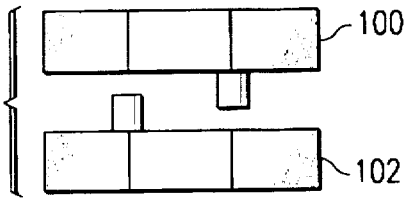
FIG. 19
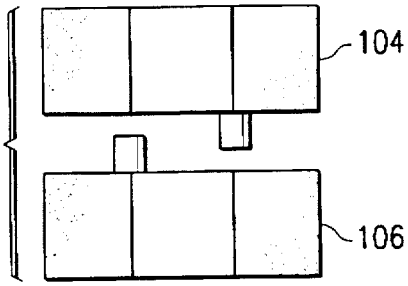
FIG. 20
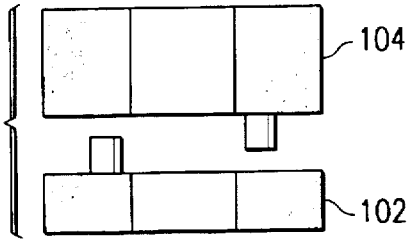

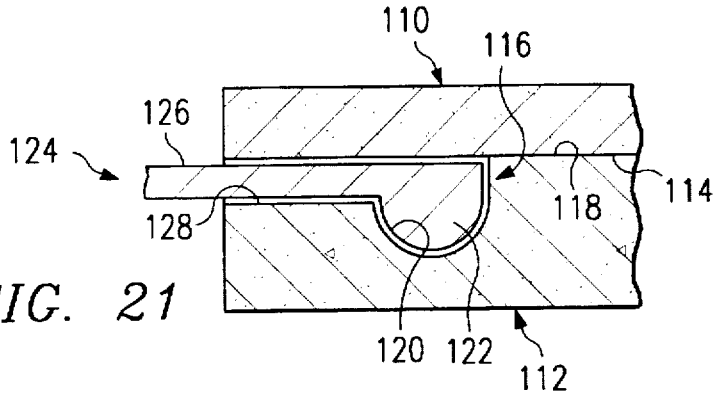
FIG. 21
FIG. 22
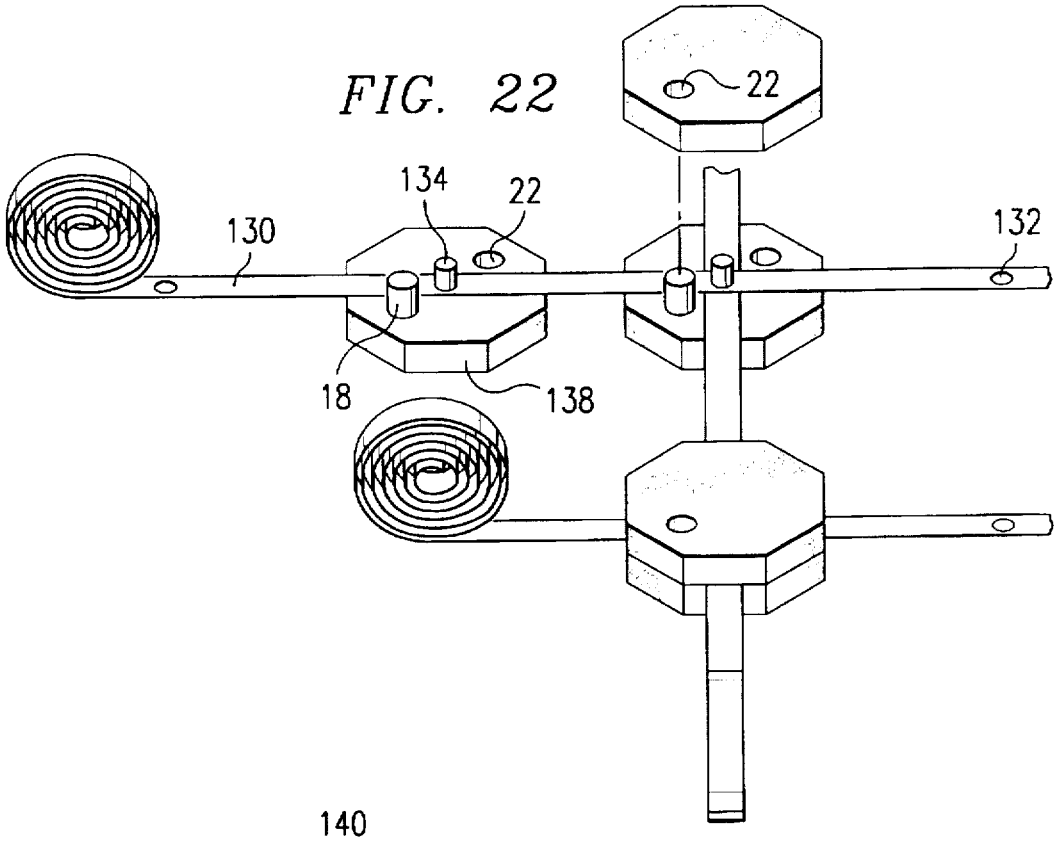
FIG. 23
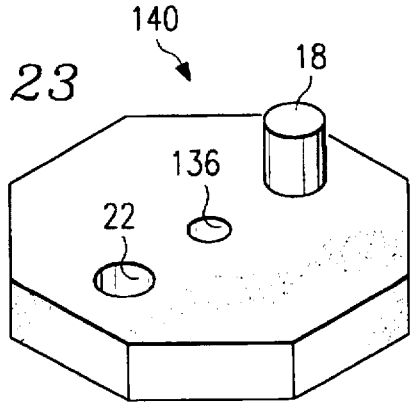

FIG. 30
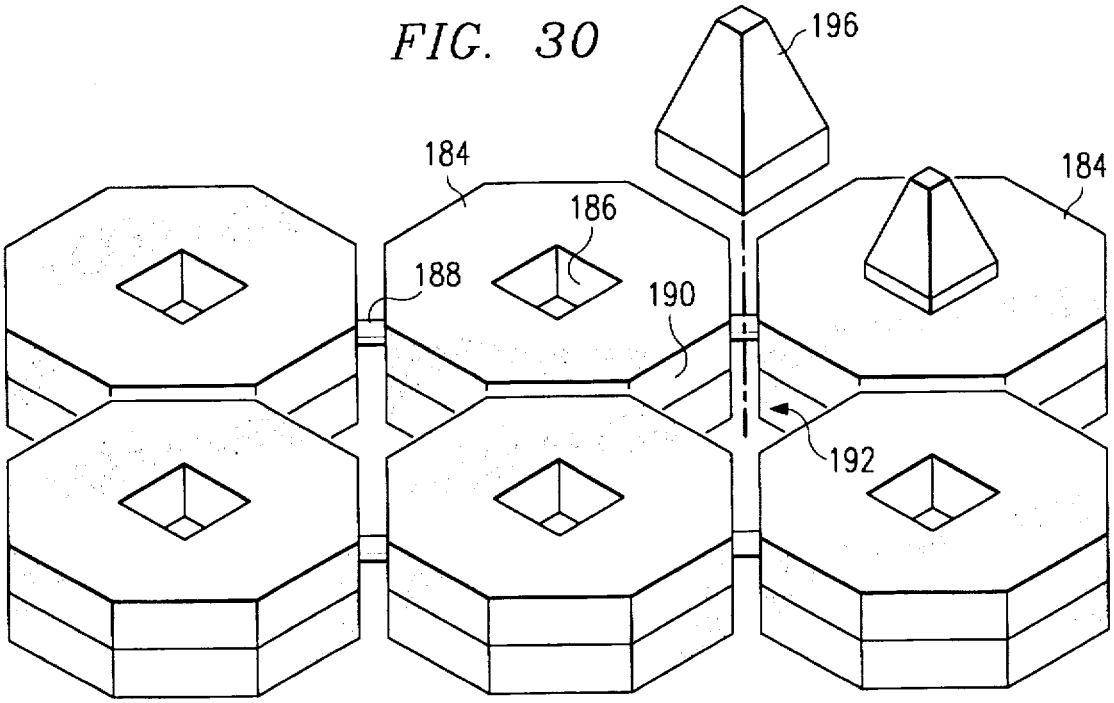
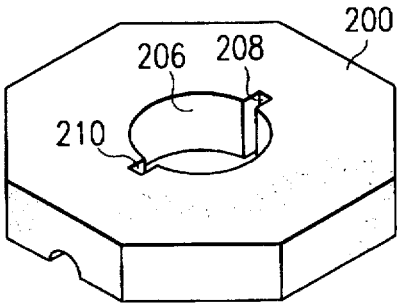
FIG. 31
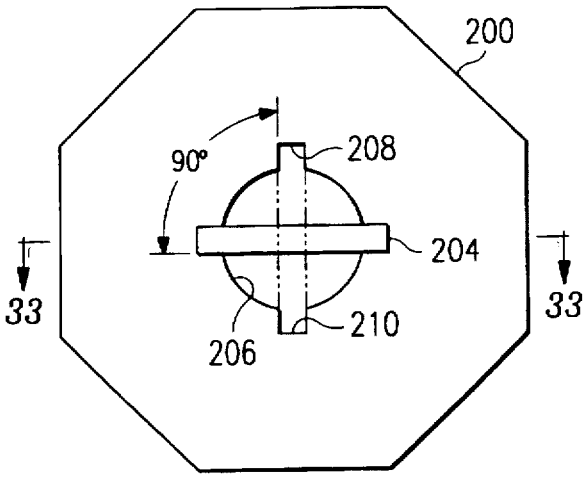
FIG. 32
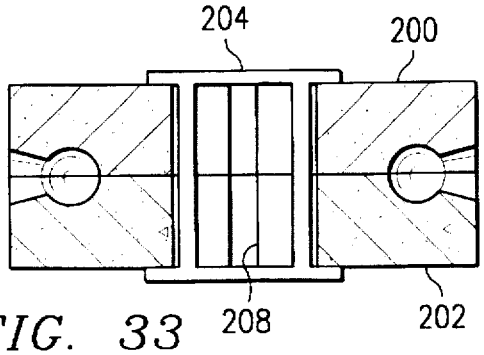
FIG. 33

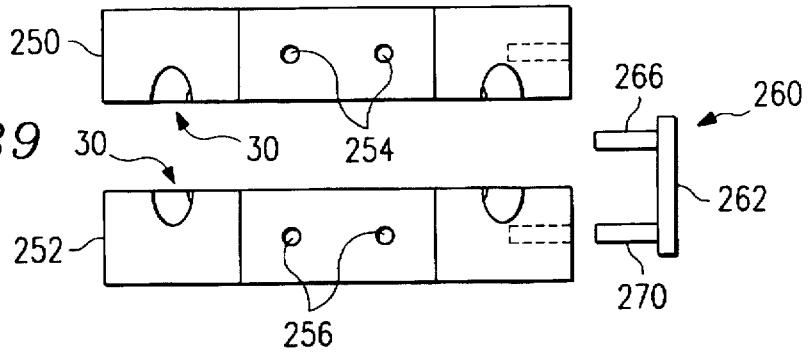
FIG. 39
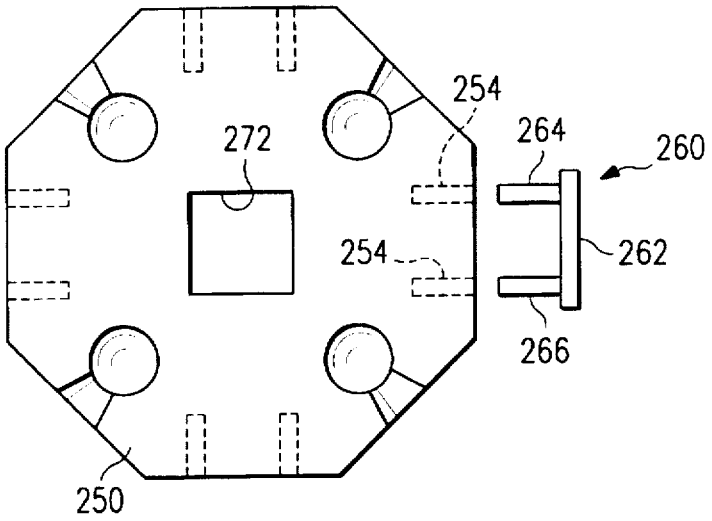
FIG. 41
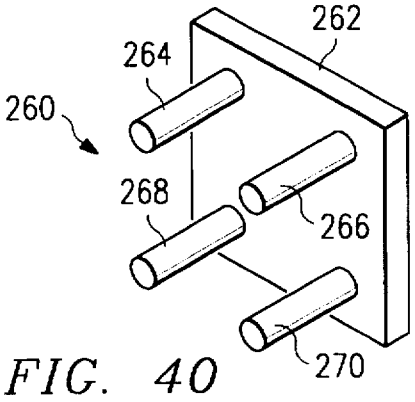
FIG. 40
FIG. 42
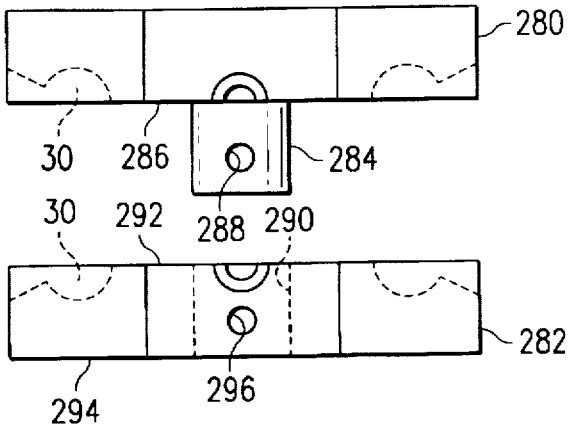

FIG. 43
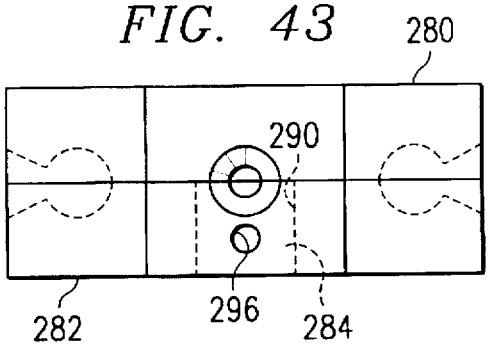
FIG. 44
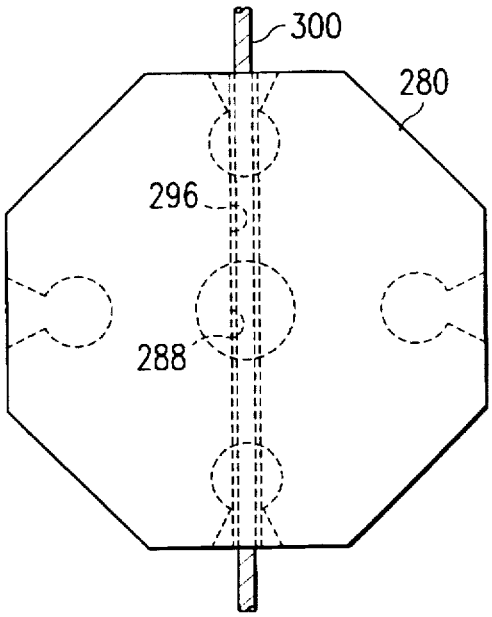
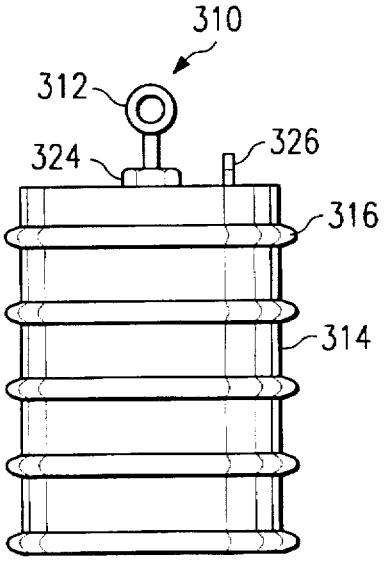
FIG. 45
FIG. 46
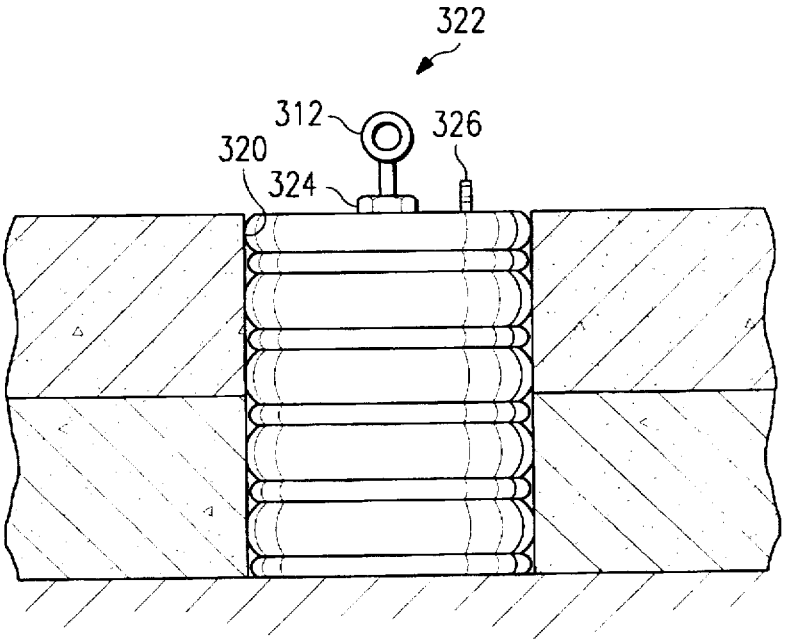

INFLATABLE PLUGS FOR INSTALLING EROSION CONTROL BLOCKS

TECHNICAL FIELD OF THE INVENTION

The present invention relates in general to techniques for installing erosion control blocks, and more particularly to inflatable devices engageable with erosion control blocks and cabled together for installing a matrix of blocks.

RELATED APPLICATIONS

This application is related to the patent application entitled "Interlocking Erosion Control Block", identified as Attorney docket No. B37718, and filed concurrently herewith.

This application is also related to the patent application entitled "Water Flow Modifier for Use with Erosion Control Blocks", identified as Attorney docket No. B37718D2, and filed concurrently herewith.

The disclosure of both applications is incorporated herein by reference.

BACKGROUND OF THE INVENTION

The erosion of soil due to the flow or movement of water, such as experienced on beaches, lake shores, waterways, channels and water shed areas is a significant concern both as to the deterioration of the land, as well as the contamination of the water by soil and chemicals dissolved in the soil. The expense and cost to repair such type of erosion can be substantial, often raging in the millions of dollars. Further, the repair of such type of eroded properties includes not only the rebuilding of the land, but often the subsequent removal of the soil which has been washed or carried down stream and settled in the navigation waterways. Also, eroded soil and associated chemicals carried by run off water often finds its way into city and municipal drainage systems, thereby causing other concerns and expenses of removal.

Revetment or erosion control blocks have been developed to limit or control the erosion of soil due to the movement of water thereover. A number of different styles of revetment blocks are currently available for satisfying particular needs. For example, U.S. Pat. No. 4,875,803 by Scales discloses blocks having interfitting tongues and cavities to prevent relative movement of one block with respect to the other. Because of the construction of the tongues and cavities, such blocks cannot be utilized in a curved path, although such blocks do provide a degree of flexibility to conform to vertical contours and curvatures of the ground. When the area to be protected with such type of blocks is curved, pie-shaped sections of grout between sections of blocks must be installed to accommodate corners and the like. A serious disadvantage of the Scales revetment block system is that, depending upon the particular arrangement, blocks with two tongues and four cavities are utilized, or blocks with three tongues and three cavities are utilized, or blocks with four tongues and two cavities are utilized, as noted in FIG. 9 of the Scales patent. Because of the different styles of blocks utilized, each block must be selected and studied briefly in order to determine how it should be oriented before being installed with the other blocks. Because of the difficulty in installing each block, the entire installation of a number of such blocks necessarily takes longer. Another severe disadvantage of the Scales blocks is the replacement of one or more blocks after the matrix of blocks has already been installed. Because of the nature of the interfitting tongue and cavities, the blocks cannot simply be lifted out of the matrix and replaced with another block. Rather, the replacement requires entire rows or sections to be removed in order to replace a single block. More practically, if a block of the Scales type is broken, the relevant area is simply grouted or cemented, which compromises the vertical flexibility of the matrix. The blocks can be cabled together to hold the blocks as a group and prevent separation due to changing soil conditions. Additionally, because of the nature of the tongues and cavities in the various blocks, they cannot be block cast, but only can be made by wet casting techniques.

U.S. Pat. Nos. 4,227,829 and 4,370,075 respectively by Landry, Jr. and Scales describe other type of revetment block that is cabled together so as to maintain a system of such blocks in a group to control the erosion of soil. The Landry, Jr., block has a cable passageway therethrough for the threading of a cable to hold the blocks together. The Scales block has two cable channels therethrough for cabling a matrix of blocks together.

U.S. Pat. No. 4,372,705 reissued as Re. 32,663 describes an articulated erosion control system utilizing two entirely different types of blocks that are interlocked together. A "lock block" is constructed entirely of a number of sockets, and a "key block" is constructed only with a number of locking arms. The lock blocks and key blocks are interlocked together and can be cabled to facilitate installation. Although the lock and key blocks are structured so that a number of them can be installed in a curved path, the arrangement has certain disadvantages. For example, since two entirely different types of blocks are necessary, the different types of blocks must be available and alternately selected by the installer during installation thereof Also, if one type of block is broken, during or before installation, then it must be replaced with an identical type. It can be appreciated that the installation, inventory and manufacture is thus more complicated, due to the necessity of two different types of blocks. Further, the arms of the key block are susceptible to breakage when installed in the socket of a lock block, and rotated or angled sideways. Because such type of blocks are constructed of concrete, the material is susceptible to breakage at the thinned portion of the arm, when such portion engages the edge in the opening of the socket and is susceptible to breaking when rotated sideways to the fullest extent. The installation of a system of such blocks is also more complicated, in that the blocks are installed in a diagonal manner, rather than along the x-y laterals of a matrix. Lastly, the cabling of such blocks is more of a necessity to prevent dislodgement due to flowing water because the key blocks are lighter in weight than the lock blocks, and thus have a tendency to be more easily lifted out of place and carried with flowing water. Because of the structure and arrangement of the key and lock blocks, the cabling thereof is substantially more difficult. The Scales block employs a hangar with eyelets that is threaded through two adjacent blocks, with a rope extended through the eyelets. The rope is used to lift a matrix of blocks.

A matrix of interlocking blocks can be assembled together on a filter cloth, as disclosed in U.S. Pat. No. 4,474,504 by Whitman et al. The ends of the filter cloth are raised by a crane and a handling bar and lowered to the area to be installed.

U.S. Pat. No. 5,484,230 by Rudloff discloses an erosion control block having a general octagonal shape, but is not interlockable with other blocks without the use of cables. Each Rudloff block has formed therein three cable channels through which cables are threaded to lift a matrix of blocks for shipping and for installation. The entire disclosures of the foregoing patents are incorporated herein by reference.

In Great Britain patent application GB 2,025,494A, there is disclosed underwater paving apparatus which is employed to install blocks underwater using a machine that feeds out cables on which the blocks are supported. The German publication 2,141,107 also illustrates a machine for installing interlocked blocks.

Many, if not most of the blocks of the prior art noted above can be installed by manually picking up each individual block and laying it in place. While this procedure is time consuming, it becomes more burdensome to install such blocks in underwater locations. To facilitate either the underwater installation of the erosion control blocks or the installation of a matrix of such blocks, cable channels or bores have been formed through the blocks. Synthetic rope cables are then threaded through the blocks so that the entire matrix of blocks can be lifted by a crane and installed. While this technique is effective, the rope cables cannot be removed and reused. This is often because the blocks themselves are not interlocking and the rope cables are the mechanism that hold the blocks together as a matrix.

From the foregoing, it can be seen that a need exists for a technique that allows cabling a number of blocks or block sets together for underwater or other installations, and where the cable can be easily recovered, thereby leaving the interlocked matrix of blocks under water to protect the grade from erosion. Another need exists for apparatus that is easily engageable with the erosion control blocks where a cable connects the apparatus, but the apparatus is easily released from the blocks and can be reused.

SUMMARY OF THE INVENTION

In accordance with the principles and concepts of the invention, an erosion control block arrangement and the installation technique described herein overcomes or substantially reduces the shortcomings of the prior art.

In accordance with one embodiment of the invention, there is disclosed a block set lock member for locking a top block to a bottom block. In other arrangements of the block set lock, a ring or loop projects above the block set to allow a rope or cable to be inserted therethrough so that a matrix of laterally interconnected block sets can be lifted with the cables and installed in underwater areas. The block set locks include a center hole configuration in the blocks where a key is inserted downwardly through the two blocks, turned sideways about 90°, thereby preventing the top and bottom blocks from being separated. Other arrangements of the block set lock include bolts that lock the top and bottom blocks together, or a marine adhesive that permanently adheres the top and bottom blocks together. In yet another block set lock, the top and bottom blocks of a set having a post-bore construction, are constructed with a lateral cable hole through the mated blocks. In this manner, when a cable is threaded through the lateral cable hole, the cable itself locks the top and bottom block together. This embodiment is advantageous in underwater applications.

An important aspect of another feature of the invention is that blocks or block sets can be cabled together and installed by a crane, or the like, and where the cabling can be recovered and reused. According to this aspect, a pneumatic plug having an eyelet hook is inserted into a central annular bore of the blocks, and a wire rope cable is threaded through each eyelet hook. The pneumatic plugs are then inflated to thereby engage the respective blocks in a gripping manner so that the blocks can be lifted by the cable. After installation by the crane, the pneumatic plugs can be deflated so that such plugs and cable can be removed and reused. The blocks of a cabled matrix can include top and bottom block sets that are laterally interlocked together by the connectors.

BRIEF DESCRIPTION OF THE DRAWINGS

Further features and advantages will become more apparent from the following and more particular description of the preferred and other embodiments of the invention, as illustrated in the accompanying drawings in which like reference characters generally refer to the same elements or parts throughout the views, and in which:

FIG. 9 is a top view of three sets of erosion control blocks connected together with connectors, with one block set swiveled sideways with respect to the other block set;

FIG. 10 is a side sectional view of two bottom blocks situated on an irregular surface and connected together by a connector, with the corresponding top blocks removed upwardly therefrom;

FIG. 14 is a view showing an alternate embodiment of a connector;

FIG. 15 is a partial cross-sectional view of a block set with the connector of FIG. 14 captured within a socket structure;

FIG. 16 is a top plan view of a number of block sets connected together to form a matrix of blocks;

FIG. 17 is a top view of an elongate socket cavity according to another embodiment;

FIGS. 18–20 are side views of erosion control blocks having different thicknesses, and thus different weights, that can be utilized in different combinations;

FIG. 21 illustrates yet another socket-connector arrangement according to another embodiment;

FIG. 22 is an isometric view of another arrangement for interlocking a number of block sets together by employing a synthetic ribbon connector that interlocks the matrix of block sets together;

FIG. 23 is an isometric view of a top block that is employed with the bottom block shown in FIG. 22;

FIG. 30 illustrates a number of erosion control blocks laterally interlocked together with connectors, and incorporating flow restricter pins that vary the flow rate of water;

FIGS. 31–33 illustrate top and bottom erosion control blocks that are fixed together with a manual turnable key;

FIGS. 39–41 illustrate another embodiment of erosion control blocks that are interlocked together by side engaging locking members;

FIGS. 42–44 illustrate yet another embodiment for locking a block set together with a cable or rope;

FIG. 45 is a side view of an inflatable, barrel-shaped pneumatic plug employed in engaging an erosion control block to lift or otherwise move the block;

FIG. 46 is a partial sectional view of an erosion control block with an inflated pneumatic plug engaging within a center bore of the block;

DETAILED DESCRIPTION OF THE INVENTION

Figure 1:
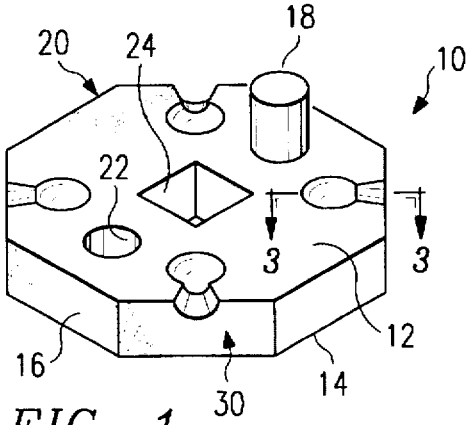
FIG. 1 is an isometric view of an erosion control block constructed according to one embodiment.

With reference to FIG. 1, there is illustrated an erosion control block 10 constructed in accordance with a preferred embodiment. The block 10 is constructed so that two such blocks can be interlocked together, as by lowering a top block onto a bottom block. Accordingly, two such blocks as shown by the block in FIG. 1 constitute a set which can be linked together with other such block sets by a connector shown in FIG. 2. With reference to the block 10, it is shown situated so as to have a top inside surface 12, a bottom outside surface 14 and an edge surface 16. The edge surface 16 can be of many different configurations, including an octagonal shape as shown. The shape configuration of the edge surface 16 can also be round, square, or a number of other geometric shapes that may be suitable for particular purposes.

The block 10 includes a post 18 formed integral with the body 20 of the block. The post 18 protrudes perpendicular from the inside surface 12. A mating bore 22 is formed in an opposite location of the body 20 of the block 10 and preferably entirely through the block 10, from the inside surface 12 to the outside surface 14. The bore 22 is preferably of a diameter somewhat larger than the diameter of the post 18 so as to be insertable with other similar blocks. Further, the axial length of the bore 22 can be somewhat longer than the height of the mating post 18. In the preferred embodiment of the invention, the post 18 is constructed with a height substantially the same as the thickness of the block 20, and the bore 22 is formed entirely through the block 20. An anchor hole 24 is also formed through the body 20 of the block 10 to allow vegetation to grow therethrough. The anchor hole 24 is shown square and placed in the middle of the block body 20, but such hole can be of any size or shaped configuration, placed substantially at any location in the block.

Figure 3:
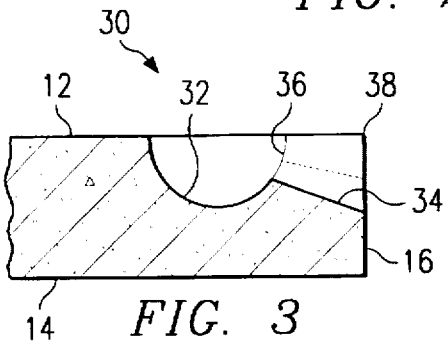
FIG. 3 is a cross-sectional view of the block, taken along line 3—3 of FIG. 1, illustrating the shape of the cavity.
Figure 4:
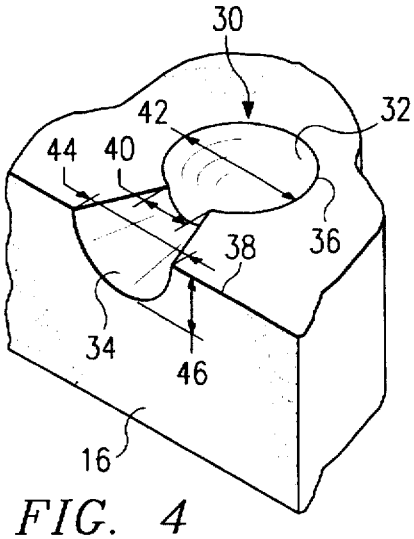
FIG. 4 is an isometric and enlarged view of a socket structure formed within the block.
Figure 5:
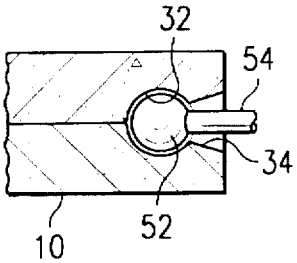
FIG. 5 is a cross-sectional view of a portion of a top block on a bottom block, showing a connector end captured within a socket enclosure.

In accordance with an important feature, a socket 30 is formed in each block 10. The socket 30 of each block is essentially a "half" socket, so that when two blocks, each with a half socket, are mated together, an enclosed full socket is formed. The full socket is adapted for capturing therein the enlarged end of a connector, to be described more fully below. In the preferred form, four sockets are formed in each quadrant of the block 10. Those skilled in the art may prefer that other numbers of sockets can be employed, again depending upon the particular application of the block. The socket 30 is shown in more detail in FIGS. 3 and 4. The shape of the socket is adapted to mate with one end of the connector 50 shown in FIG. 2.

Figure 2:
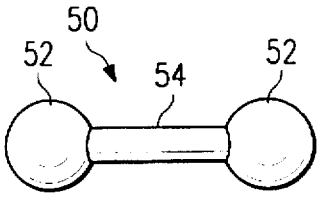
FIG. 2 is an isometric view of a connector for connecting similar blocks together.

The socket 30 includes a convex or cup-shaped cavity 32 formed within the inside surface 12 of the block 10. The shape of the cavity 32 is complementary to the shape of the enlarged end 52 of the connector 50. As will be described in more detail below, the cavity 32 and the shape of the enlarged end 52 of the connector 50 can be of various complementary configurations and shapes. The shape of the connector 50 shown in FIG. 2 is similar to that of a dumbbell used in weight lifting exercises. A channel 34 is formed as a cone-shaped depression in the inside surface 12 of the block 10 and extends between the cavity 32 and the edge surface 16 of the block 10. The corner edge 36 of the socket cavity 32 is spaced from the corner or edge 38 of the block. The width 40 of the channel 34, where it intersects with the socket cavity 32 (shown in FIG. 6) is smaller than the overall diameter of the cavity 32. The smallest diameter 40 of the cavity 32 is also somewhat larger than the diameter of the arm portion 54 of the connector 50. Importantly, the larger diameter 44 (FIG. 6) of the cone-shaped channel where it opens to the edge surface 16 of the block is greater than the diameter 40. With this construction, the enlarged end 52 of the connector 50 can be disposed and captured in the socket cavity 32, with the connector arm 54 located in the channel 34. The connector 50 can then be pivoted about a circular acute angle in a horizontal and vertical manner while the enlarged end 52 of the connector remains engaged within the socket cavity 32. Preferably, the radial length of the channel 34 between the edge surface 16 and the socket cavity 32 is about one-third of the length of the arm 54 connecting the enlarged ends 52 of the connector 50. It can also be appreciated that when a connector 50 is installed within the socket 30 of the block 10, and a similar block laid thereover, the connector 50 is securely captured therein.

With reference again to FIG. 1, it is noted that in the preferred form of the invention, four sockets 30 are formed in the inner surface 12 of the body 20 of the block 10. In order to maintain a high degree of structural integral to the block 10, the post 18 is located between two adjacent sockets, and the bore 22 is oppositely located in the block 10 between two other sockets 30. The anchor hole 24 is formed in the middle of the block 10, between the post 18 and the mating bore 22.

Figure 6:
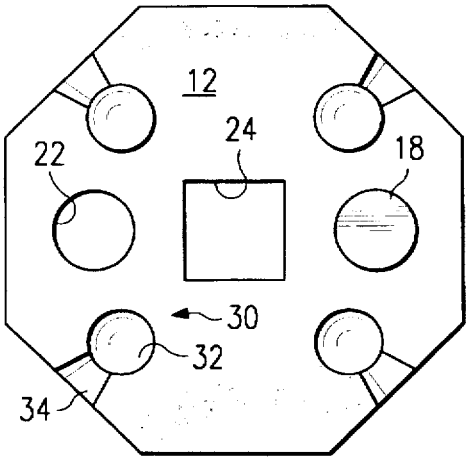
FIG. 6 is a top plan view of the block of FIG. 1.

As noted above, a second block of similar construction as that shown in FIG. 1 can be mated with the first block, with the connector 50 captured in the sockets, such as shown by FIGS. 5 and 10–13. The block, as shown in the top view of FIG. 6, is preferably constructed in the general shape of an octagon. The block 10 is not constructed as a regular octagon, but rather with a shape where the four sides associated with sockets 30 are of equal length, and the remaining four corner sides are shorter. In the preferred form, the four sides associated with sockets are about 12 inches long, whereas the corner sides are about 4.56 inches long. This irregular octagonal shape provides a smaller corner opening between blocks when installed side by side, as shown in FIG. 16. A regular octagonal shaped block can be utilized when a larger corner opening is desired between adjacent blocks to provide a larger area for the growth of vegetation therein to anchor a matrix of such blocks. The width from one planar edge surface 16 having a socket 30, to an opposite edge surface is contemplated to be about 18 inches. The block can be constructed of a 4,000 psi type of concrete or cement. Blocks having a 2" height will therefore weigh about 41 lbs., while blocks of 4" in height are expected to weigh about 82 lbs. The height of the post 18 is preferably the same as the thickness of the body 20 of the block 10, and the bore 22 is formed entirely through the body 20, from the top surface 12 to the bottom surface 14 thereof. The vegetation anchor hole 24 is optional, but preferably a square opening having a dimension of about three inches. The diameter 42 of the socket cavity 32 is about 1.26 inches. The depth of the cavity is half the diameter. The smaller and larger diameters of the cone-shaped channel are about 0.75 inch and about 1.5 inches, respectively. Lastly, the radial length of the channel 34 is about 1.25 inches.

In the preferred form, the connector 50 includes two spherical, enlarged ends 52, each having a diameter of about 1.15 inches. The arm 54 is preferably rod-shaped, with a diameter of about 0.5 inch and a length of about 7.5 inches. A clearance between a socket cavity 32 and the connector end 52 is expected to be about ⅛–1/16 inch. It is contemplated that the connector 50 will be constructed of a steel or iron material and coated with a material to prevent corrosion. Galvanized, zinc or other types of coatings are durable and well suited for preventing rust or other kinds of oxidation. While the connector 50 is preferably constructed of a metal, due primarily to cost, other strong and durable materials can be utilized, such as polypropylene and other synthetic materials.

Figure 7:
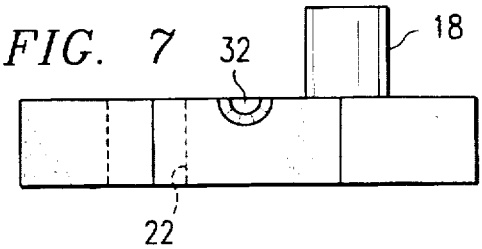
FIG. 7 is a side view taken along line 7—7 of FIG. 6, showing the post and bore formed therein.
Figure 8:
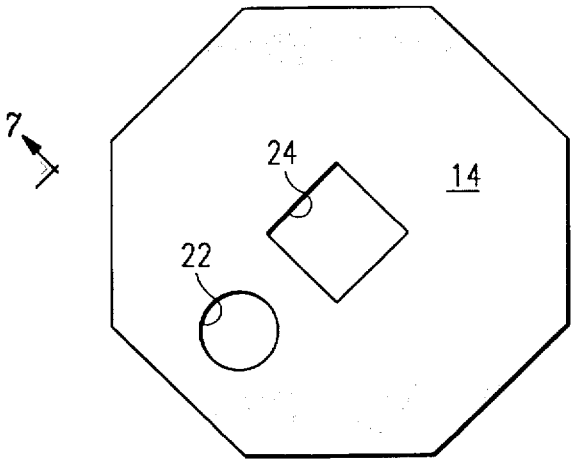
FIG. 8 is a bottom plan view of the block of FIG. 1.

A top view of the erosion control block 10 is shown in FIG. 6, with a corresponding side view shown in FIG. 7. FIG. 8 illustrates the features of the erosion control block 10, as seen from the bottom surface 14 thereof As can be appreciated, the designations "top", "bottom" and "side" are merely for purposes of description herein, and do not in any way require that the block be installed in applications conforming to such surface identifications. In other words, when the erosion control block 10 shown in FIG. 1 is inverted, obviously the "top" and "bottom" surfaces are reversed. Indeed, in severe erosion control applications, such as on a steep, nearly vertical surface, the "top" and "bottom" surfaces of the block may indeed be mostly vertical and constitute "side" surfaces. In other words, such designations merely represent particular surfaces, and not orientations of the block when utilized in actual practice.

With reference now to FIG. 9, there is illustrated three top erosion control blocks 10*a*, 10*b* and 10*c* of respective sets joined together by connectors 50. It can be seen that the block set 10*b* can be either rotated or moved laterally with respect to block set 10*a*, due to the lateral pivotal freedom of the connector arm 50 when the respective enlarged ends 52 are captured within the respective sockets of the block sets. The block set 10*b* in FIG. 9 is shown moved a maximum extent with respect to block set 10*a*. Of course, the block set 10*b* can be moved or rotated with respect to the block set 10*a* in the opposite direction and thereby provide a large degree of lateral orientation. The ability to rotate one block set with respect to another without the possibility of breakage allows a group of such block sets to be installed around gradual curves while yet remaining interlocked together. In this manner, the hydraulic pressure exerted upon one or more blocks will not cause block movement, due to the weight of the individual blocks as well as the entire matrix of block sets being interlocked together.

FIG. 10 illustrates two sets of blocks 10*a*–10*d* with the upper blocks 10*a* and 10*b* shown removed upwardly from the lower blocks 10*c* and 10*d*, for purposes of clarity. As can be seen, the post 18*c* of the bottom block 10*c* is insertable within the bore 22*a* of the top mating block 10*a*. In like manner, the pin 18*a* of the top block 10*a* becomes inserted into the bore 22*c* of the bottom block 10*c* to thereby prevent relative lateral movement between the top and bottom blocks. Furthermore, the sockets 30*a* and 30*c* form an enclosure around the enlarged end 52 of the connector 50, thereby capturing one end of the connector 50 with respect to mated blocks 10*a* and 10*c*. The other set of blocks 10*b* and 10*d* are shown at a different elevation, due to the irregularity of the surface upon which the sets of blocks are installed. Nonetheless, because the connector 50 is allowed a certain degree of vertical pivotal motion, the blocks of the invention are ideally suited for installation on surfaces of irregular or varying elevations. The weight of the top blocks 10*a* and 10*b* prevents the blocks from being lifted when a lateral pulling force is exerted on the connector 50.

It can be seen from FIG. 10 that the replacement of any broken component of the arrangements can be readily replaced. To replace a top block, the broken block need only be removed and replaced with a new block. The replacement of a connector is easily accomplished by removing two top blocks, replacing the broken connector, and then reinstalling the two top blocks on the respective bottom blocks with the connector ends captured between the block sets. The replacement of a bottom block involves the removal of the top block and the four connectors, replacing the bottom block, and reinstalling the four connectors and the top block.

Figure 11:
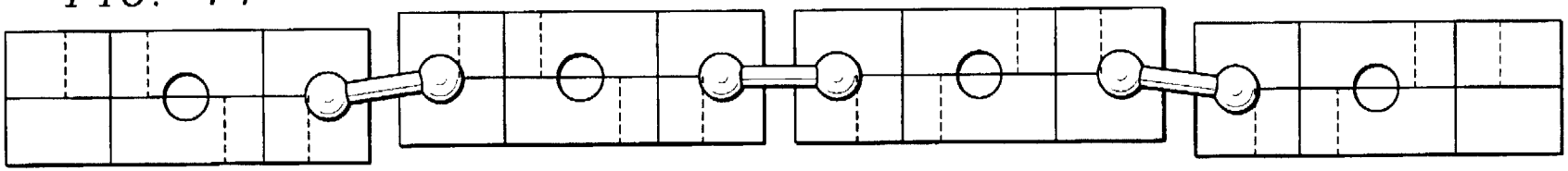
FIGS. 11–13 are side views of sets of erosion control blocks interlocked together on different ground contours.
Figure 12:
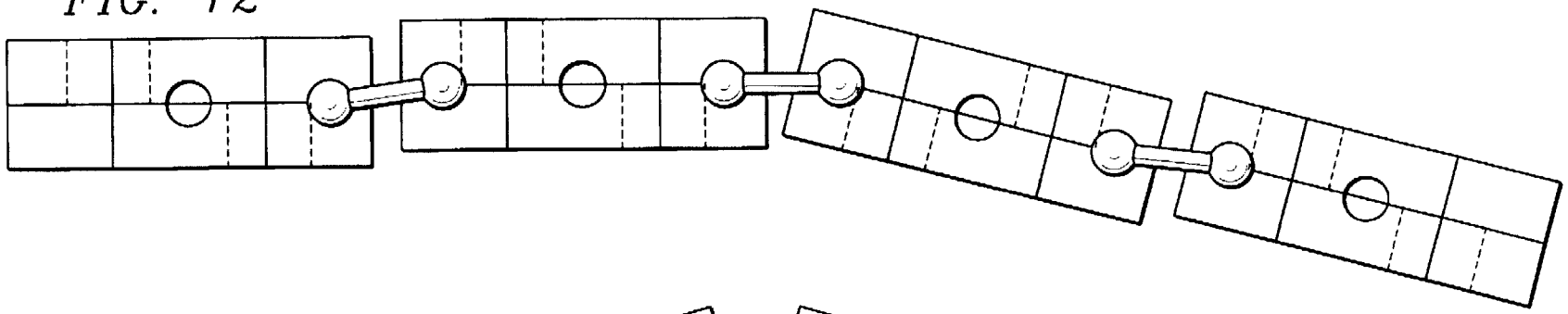
Figure 13:
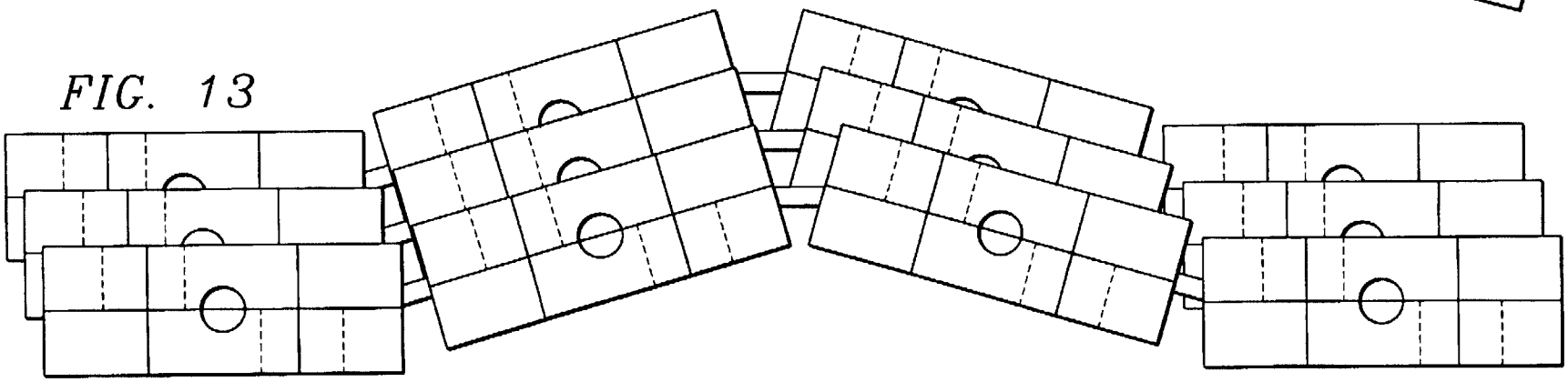

FIGS. 11–13 illustrate a number of erosion control block arrangements interlocked together over different contours of the earth desired to be protected from erosion. FIG. 11 shows that the blocks can be laid over a knoll or crown and yet remain interlocked together. FIG. 12 illustrates that the blocks themselves need not remain level, but can be oriented on an incline. FIG. 13 shows a number of rows of interlocked erosion control blocks that are laid over a crown as the back portion of the crown extends uphill.

While the preferred form of the connector has generally rounded enlarged ends 52, as shown in FIG. 2, other configurations are possible, and may indeed even be advantageous in certain situations. In FIGS. 14 and 15, there is shown a connector 60 having an enlarged end 62, a generally flat inside surface 64, a flat outside surface 66, and an annular peripheral edge 68. In FIG. 15, there is depicted a corresponding socket 70 that forms a similar-shaped cavity to capture the enlarged end 62 of the connector 60. Importantly, with this configuration, the generally flat inside surface 64 engages a generally planar vertical surface 72 of the cavity. Accordingly, when a horizontal pulling force is exerted on the connector 60, there is no tendency to lift the upper block 80 with respect to the lower block 82. In all other respects, the channel 34 is the same as that described above in connection with FIGS. 3 and 4. Those skilled in the art may prefer to utilize features of either of the connectors shown in FIG. 2 or FIG. 14 to achieve yet other advantages. In other words, a combination of flat surfaces on the connector end can be utilized to prevent uplifting of the top block, and other rounded surfaces can facilitate lateral pivotal movement of the connector within the socket while yet preventing concentrated pressure points of small contact areas between the enlarged end of the connector and the socket.

With reference now to FIG. 16, there is depicted a number of erosion control block sets interconnected together to form a small portion of a larger matrix. As can be seen, the octagonal shape of the blocks forms a generally square corner opening 90 when four block sets are joined together with the respective connectors 50. It can also be visualized that if the blocks are formed with a square body, the corner opening 90 is substantially smaller, being only the spacing between adjacent blocks. The spacing between adjacent blocks is generally a function of the length of the connector arm 52. Hence, connector arms of different lengths can be employed to provide different spacings between blocks. It is contemplated that the spacing between blocks will be in the neighborhood of about three inches. In this manner, the extent to which vegetation grows between the blocks to facilitate anchoring the blocks to the ground can be controlled by the lateral spacing between the blocks. Also, and as noted above, the anchor holes 24 formed within the blocks allow vegetation to anchor each individual block set and thus facilitate anchoring of the entire matrix as a whole.

The spacing between the erosion control blocks of the invention can also be varied by utilization of elongate socket cavities 92, as shown in FIG. 17. With this construction, the enlarged end 52 of a connector 50 can move radially within the elongate cavity 92 and yet remain captured therein. The configuration of the elongate cavity 92 allows different spacings between blocks, and thereby facilitate the extent of vegetation growth therebetween.

The density or type of material with which the erosion control blocks of the invention are fabricated can be selected to achieve different weights. Also, different types and sizes of aggregate can be selected to achieve different weights and strengths of the blocks. It is contemplated that the erosion control block can be economically fabricated using a wet casting type of process. The weight of a combination of an upper and lower mating block can be controlled by using blocks of different thicknesses, as shown in FIGS. 18–20. In FIG. 18, there is illustrated a top block 100 and a bottom block 102, each being substantially identical in shape and with a thickness of about two inches. Thus, the octagonal blocks are about four inches in total thickness when mated together, and are expected to weigh about 82 lbs., given a lateral dimension of about 18 inches. In FIG. 19, there are shown mating blocks 104 and 106, each being about four inches thick. Accordingly, when such blocks are mated together, the total thickness is about eight inches and the combination is expected to weigh about 164 lbs., given a lateral width of about 18 inches. In FIG. 20, an intermediate weight of the mating blocks is achieved. Here, the bottom block 102 is two inches thick, while the top block 104 is four inches thick, thereby providing a total height of about six inches and a weight of about 123 lbs. The versatility of this arrangement is facilitated by forming the height of the posts 106 of the four-inch blocks 104 to be no greater than the thickness of the two-inch thick blocks 102. In this manner, the posts 106 of the larger top block do not protrude through the bottom surface of the thinner bottom block 102. Yet, other combinations of block thicknesses can be utilized, and mixed and matched to achieve desired overall weights of mated combinations. It is to be understood that the foregoing dimensions and block weights are expected for general excavation and erosion control purposes. For oceanic applications and in rough or deep water situations, the blocks can be made much larger with weights ranging in the tons.

With reference to FIG. 21, there is illustrated yet another embodiment providing top and bottom mating blocks interconnected with others by a connector. In FIG. 21, there is illustrated a top block 110 and a bottom block 112 that have a different cavity and connector arrangement, but are otherwise substantially identical to the blocks shown in FIG. 1. The top block 110 includes a substantially planar inside surface 114, with a cavity 1 16 formed only in the inside surface 118 of the bottom block 1 12. The socket 116 includes a cavity 120 for capturing the enlarged end 122 of a connector 124. The arm 126 of the connector 124 passes through a channel 128 formed entirely in the inside surface 118 of the bottom block 112. Importantly, the top surface of the connector 124 does not protrude above the inside surface 1 18 of the bottom block 1 12. Although this arrangement requires a top block 110 and a bottom block 112 of different configurations, such blocks can nonetheless be mated together and interlocked to other similar blocks with a connector 124. The connector 124 remains captured and engaged within the socket 116 in substantially the same manner as described above.

Those skilled in the art can readily realize from the foregoing that yet other variations are possible. For example, block sets can be constructed with only a single bore in one block and a single mating post in the other block of a set. Although this arrangement provides mateable top and bottom blocks, two different types of blocks are necessary. Additionally, the preferred installation technique includes the use of either a woven or nonwoven synthetic geotextile filter fabric. The fabric is generally well known for protecting the soil particles from being carried away with the flow of water. The weight of the erosion control blocks on the fabric maintains the fabric in place.

With reference to FIG. 22, there is shown another block arrangement useful for connecting a number of block sets together without utilizing the socket/connector apparatus described above. Rather than utilizing individual connectors 50, a flexible ribbon connector 130 is employed. The ribbon connector 130 is preferably constructed of a synthetic material, such as polypropylene, and molded so as to form therein a number of holes 132. The holes 132 in the ribbon connector are spaced apart so that the center pins of either the top or bottom blocks pass therethrough and into the center holes 136 of the opposite blocks of a set. The construction of the block set of this arrangement may be different from that described above so that the blocks can be interlocked together with the ribbon connector 130. As shown in FIG. 22, the bottom block 138 can be constructed with the post 18 and corresponding bore 22, and with a center pin 134 insertable through a hole 132 of the ribbon connector 130. The other mating block 140 shown in FIG. 23 is formed with a center hole 136 for receiving therein the pin 134 of the other block 138.

In other forms of the block set, each block can be formed with a center hole 136, and a separate pin can be utilized for insertion into the holes 136 of both mateable blocks to thereby capture the ribbon connector therebetween, via the hole 132 therein. Also, both blocks of the set need not each include both a bore 22 and a post 18, but each block set need only include a single bore 22 on one block engageable with a post 18 in the other block. Further, and to be described in more detail below, a pin having a flow enhancer or restricter head can be employed to fasten the blocks 138 and 140 together and to the ribbon connector 130.

The ribbon connector 130 can be made in long continuous rolls and unrolled at the installation site after the bottom blocks 138 have been laid in a general pattern on the ground. The ribbon connector 130 can be formed with a thickness suitable to provide the strength necessary to anchor the block sets together on irregular terrain and for anticipated hydraulic pressures exerted on the blocks. Moreover, the ribbon connector 130 need not be formed as a single strip as shown, but can be formed as an integral x-y matrix, or as a blanket type mat with spaced-apart openings.

Figure 24:
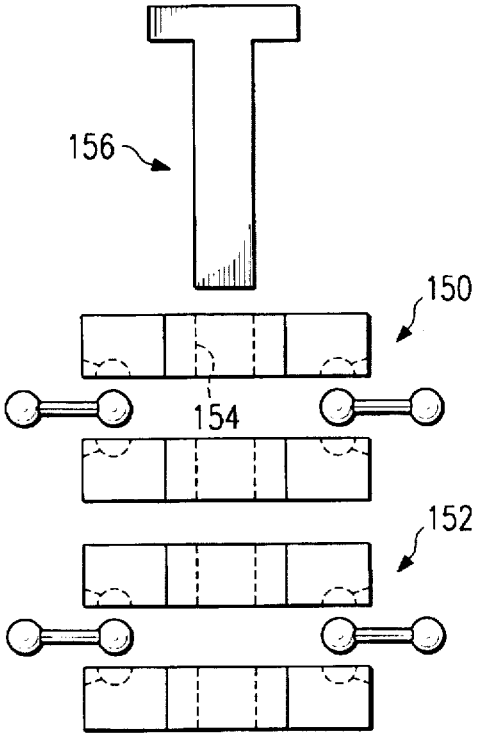
FIGS. 24 and 25 illustrate upper and lower block sets that are engaged together with a center anchor pin.
Figure 25:
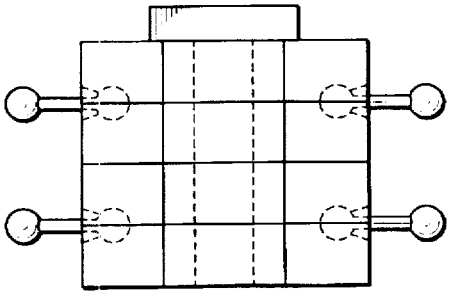
Figure 26:
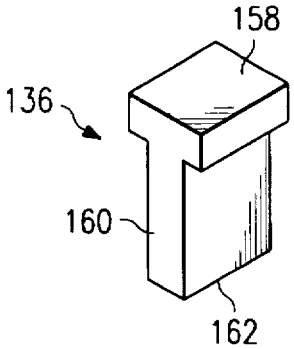

FIGS. 24–26 illustrate an erosion control block arrangement for fastening multiple blocks or block sets together. The upper and lower block sets 150 and 152 are similar to those described above in conjunction with FIGS. 1–10. However, in block sets 150 and 152, the anchor hole 154 is rectangular in shape to accommodate passage therethrough of the block set anchor pin 156, shown also in FIG. 26. The anchor pin 156 includes a head 158 and a stake portion 160 that passes through the anchor hole 154 in both block sets 150 and 152. It can be appreciated that the cross-sectional shape of the stake 160 can be other that rectangular, such as square, hexagonal, octagonal, etc., as would be the mating anchor hole formed in the block or blocks. A stake having such a shape prevents the rotation of the blocks or block sets with respect to each other. If the rotational or nonrotational aspect of the blocks with respect to each other is of no concern, the shape of the stake 160 can also be round, as would be the anchor hole 154. Moreover, while the bottom end 162 of the anchor pin 156 is shown as being flat, the shape thereof can also be pointed to facilitate the driving of the pin through the anchor holes of all the block sets 150 and 152, through the geotextile fabric and into the ground. Alternatively, the length of the stake 160 can be sufficient so as to extend through only the combined thicknesses of the blocks. Preferably, the anchor pin 156 is constructed of a material that is heavy and does not rust, such as cement, galvanized-coated steel, or even a synthetic material that has a density greater than that of water.

Figure 27:
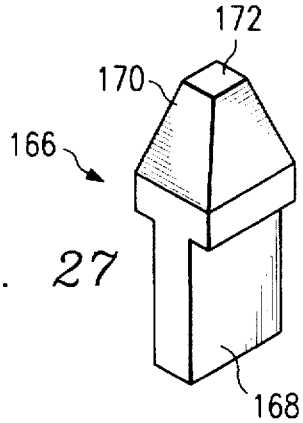
FIGS. 26–29 illustrate various head shapes of anchor pins.
Figure 28:
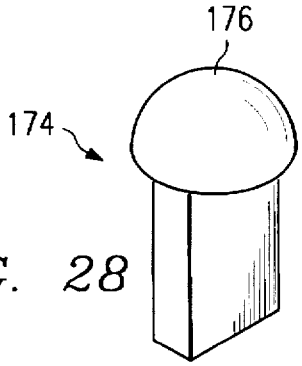
Figure 29:
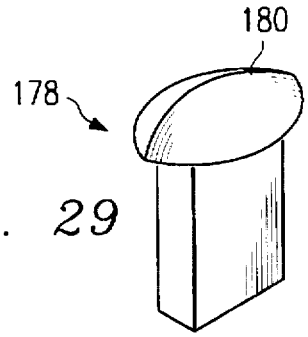

FIGS. 27–29 illustrate other head configurations of anchor pins useful in fastening erosion control blocks together, or simply anchoring a single erosion control block to the ground. In FIG. 27, the anchor pin 166 has a stake portion 168 with a head 170 that extends upwardly to a converging point 172. The pointed head 170 functions as an energy dissipater to slow down the velocity of water. Other head shapes, such as conical, square, rectangular, round, etc., can also function to transform a laminar flow of water into a turbulent flow, thereby reducing or otherwise modifying the flow velocity.

FIG. 28 illustrates an anchor pin 174 having a head 176 shaped as a hemisphere. This shape is particularly well suited to enhance the flow of water. In FIG. 29, the anchor pin 178 has a head 180 shaped similar to a fish scale to thereby enhance the flow of water. In this instance, rather than slowing the flow of the water, the fish-scale shape of the anchor pin head 180 facilitates the flow of water.

With regard to FIG. 30, there is illustrated a matrix of erosion control blocks 184, each having a square-shaped anchor hole 186. Each erosion control block 184 is substantially similar in shape, interconnected with neighbor blocks by a connector 50, similar to that shown in FIG. 2. Moreover, each block 184 is octagonal-shaped, having a corner diagonal edge 190 of a length such that the opening formed by four neighboring blocks is about the same size as the center anchor hole 186. A flow restrictor anchor pin, such as shown by reference character 196, has a square-shaped stake (not shown) of a cross-sectional size that can be inserted into either the center anchor hole 186 of one block or into the corner opening 192 between four neighboring blocks. The stake of the flow restricter pin 196 can be of sufficient length so as to simply be engaged within the anchor hole 186 of one block, or can be pointed so as to be pushed through the geotextile fabric into the underlying ground. With this arrangement, a large number of flow restricter pins 196 can be utilized to achieve a greater restriction of the flow rate of the water. Indeed, various flow patterns can be accomplished by populating various anchor holes 186 and/or corner openings 192 with flow restricter pins 196.

FIGS. 31–35 illustrate yet another embodiment of the invention, where the erosion control blocks are not only interlockable laterally together to neighbor blocks with the connector pins 50 (FIG. 2), but also are interlockable as between the top and bottom blocks of a block set. FIG. 31 illustrates a top block 200 and FIG. 33 illustrates a top block 200 interlocked with a bottom block 202 by the utilization of a manually operated key 204. The top block 200 and bottom block 202 are formed with a center bore 206, which preferably is a circular bore. Formed oppositely to each other within the circular bore 206 is a pair of vertical key slots or channels 208 and 210. As can be seen, the diametric length of the channels 208 and 210 is greater than the diametric dimension of the circular bore 206. The key 204, shown in more detail in FIGS. 34 and 35, includes a body portion 212 that has an overall lateral dimension substantially the same as the diameter of the circular bore 206. The key 204 includes four locking ears 214 that extend laterally beyond the lateral width of the body 212. The lateral width between the top pair of locking ears is substantially the same lateral dimension between the channels 208 and 210. The bottom locking ears 214 are similarly shaped as the top locking ears. With this arrangement, when a top block 200 and a bottom block 202 are arranged as shown in FIG. 33, with the opposing channels 208 and 210 aligned between the blocks, the bottom locking ears 214 of the key can be inserted in the aligned channels 208 and 210 of the top and bottom blocks. When the bottom locking ears 214 pass entirely through the bottom block 202, the key 204 can be manually rotated 90°, as shown in FIG. 32, thereby locking the top and bottom blocks together. When interlocked together, the top block 202 and bottom block 202 remain as an integral unit, until the key 204 is rotated another 90° so that it can be lifted and removed from both blocks. The key 204 can be constructed of a synthetic material such as nylon, or from a galvanized-coated metal or other noncorrosive material.

Figure 34:
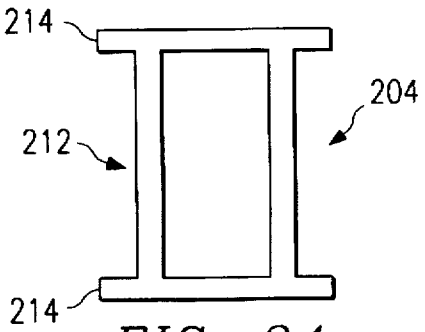
FIGS. 34 and 35 illustrate the construction of a key for interlocking top and bottom blocks together.
Figure 35:
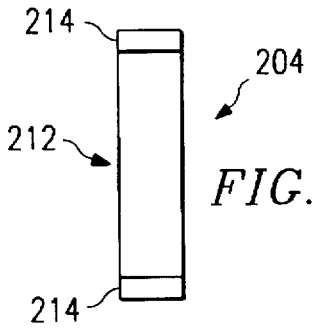
Figure 36:
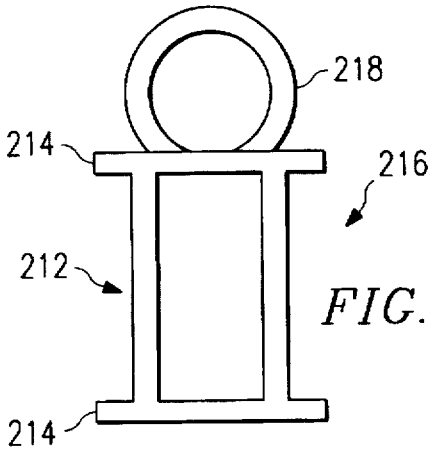
FIG. 36 illustrates another embodiment of a key useful for cabling a number of interlocked blocks together.

In FIG. 36, there is illustrated another embodiment of a locking key 216. In this embodiment of the locking key, the body 212 and ears 214 are substantially the same as shown in FIGS. 34 and 35. However, the key 216 includes a handle 218 formed integral with the body. The handle 218 is formed in the shape of an enclosed ring to facilitate the manual handling of the key, and the turning thereof to interlock the top and bottom blocks 200 and 202 together. Moreover, the ring 218 can be employed as a mechanism so that a synthetic rope or cable can be passed therethrough and between neighboring blocks to allow of a matrix of such block sets to be lifted and lowered into a waterfilled channel. Moreover, the handle 218 can be shaped to provide water-flow restriction functions. Indeed, the water-flow restricter 196 shown in FIG. 30 can be mounted or otherwise formed integral with the key 204 (FIG. 34) so as to provide multiple functions. With such an arrangement, the key not only interlocks the top and bottom blocks together, but also provides a flow restriction function as well as a mechanism to allow cabling of a number of blocks together for installation of a matrix of blocks in underwater locations.

Figure 37:
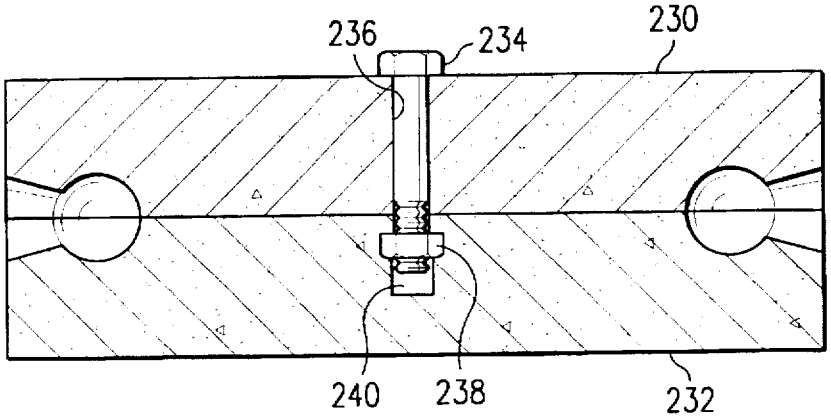
FIG. 37 illustrates top and bottom erosion control blocks fastened together with a bolt.
Figure 38:
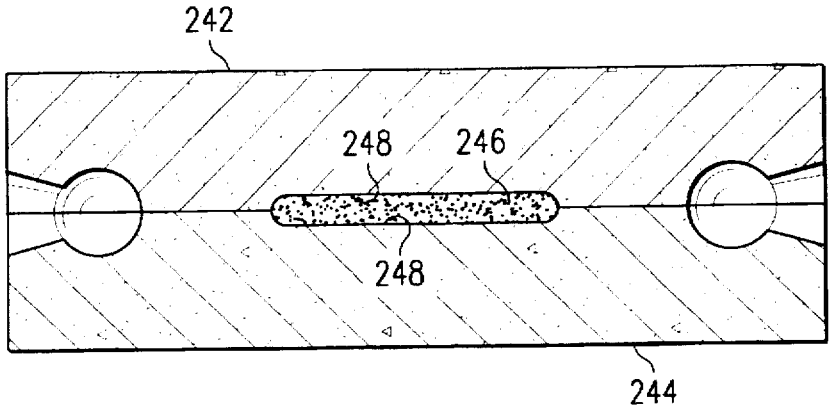
FIG. 38 shows top and bottom erosion control blocks interlocked permanently together with an adhesive.

FIGS. 37 and 38 illustrate yet other techniques for locking top and bottom erosion control blocks together. With regard to FIG. 37, the top block 230 is fastened to the bottom block 232 by way of a bolt 234. The top block 230 includes a bore 236 formed therethrough with a size to accommodate the shank of the bolt 234. The bottom block 232 includes an internally threaded nut 238 embedded within the material of the block. A bore 240 is formed in the bottom block 232 so as to accommodate the threaded end of the bolt 234. Top and bottom blocks formed with this construction can be interlocked together, or separated from each other to replace broken blocks or corresponding connectors 50. The head of the bolt 234 can be formed with a closed ring so as to be cabled with other blocks. Rather than utilizing a bolt and nut, a lag screw and lead insert can be employed to lock the top block to the bottom block. In addition, more than one fastener can be utilized in locking the blocks of a set together. Similarly, the bolt 234 or lag screw can be formed with a head shaped to provide flow restriction functions.

FIG. 38 illustrates a top erosion control block 242 and a bottom erosion control block 244 that are interlocked together by way of an adhesive 246. The top and bottom blocks 242 and 244 are each formed with a shallow pocket 248 to accommodate a pool of a settable adhesive. Adhesives of the epoxy type are well suited for underwater applications. The interlocked block set of FIG. 38 is well adapted for use in forming a matrix of blocks at the installation site, where water has not yet accumulated. The bottom blocks and corresponding interlocking connectors 50 (FIG. 2) are first installed, then an adhesive is applied to both the pocket 248 of the bottom block 244 as well as the pocket 248 of the top block 242, whereupon the top block 242 is then laid on the bottom block 244. The block sets of the matrix are then allowed to set and cure so that the block sets are permanently interlocked together. The embodiment of FIG. 38 can be modified so that the top block includes a cable hook fastened therethrough. The cable hook can then be employed for cabling a number of blocks together in a matrix and lifted by a crane and installed in underwater applications.

FIGS. 39–41 illustrate yet another embodiment of erosion control blocks of a set that can be interlocked together. The top block 250 and the bottom block 252 are symmetrical in shape and design. The top block 250 and bottom block 252 include corresponding socket cavities 30 at the corner edges of the hexagonal-shaped blocks. On the other four edges of the blocks there are formed pairs of lateral holes 254 and 256. The holes are formed parallel to each other and toward the center of each block. An interlocking member 260 is utilized to lock the top block 250 to the bottom block 252. The locking member 260 includes a planer plate 262 having formed integral therewith four elongate pins. The upper pins 264 and 266 are insertable into the pair of holes 254 of the top block 250, whereas the bottom spaced-apart pins 268 and 270 are inserted into the pair of holes 256 of the bottom block 252. Four such locking members 260 are utilized to clamp the four opposite sides of the block set together. The blocks 250 and 252, when interlocked together with the members 260, are fastened together so as to prevent inadvertent separation of the top and bottom blocks. However, if repair of the blocks is required, the members 260 can be pried out of the respective pairs of holes so that the top block 250 can be removed from the bottom block 252. As shown in FIG. 41, the blocks include a center opening 272 that can accommodate a flow restricter or enhancer. Alternatively, the hole 272 can simply be left open to allow the growth of vegetation therein. As can be seen from the embodiment of FIG. 41, neighboring blocks are interlocked at the diagonal corners thereof by way of the connectors 50 and the sockets 30. At each diagonal corner of four neighbor blocks, there need only be a single connector 50.

In yet another version of the erosion control block shown in FIGS. 39–41, the sockets 30 can be formed on the same block edges in which the lateral holes 254 and 256 are formed. In this arrangement, the locking member 260 is attached to the same side edge of the block as the sockets 30. The locking member 260 of FIG. 40 is modified to include a center opening to allow the passage therethrough of the enlarged end 52 of the connector 50 (FIG. 2).

FIGS. 42–44 illustrate yet another embodiment of the invention where a top and bottom block of a set are interlocked together with a rope or cable. In FIG. 42, the top block 280 is shown with a octagonal shape, as is the bottom block 282. The blocks 280 and 282 preferably include sockets 30 for accommodating a connector 50, such as shown above in FIG. 2. The top block 280 includes a post 284 protruding from a bottom surface 286 thereof, about the same distance as the thickness of the bottom block 282. The post 284 includes a lateral hole 288 formed therethrough. The bottom block 282 includes a bore 290 formed from the top surface 292 to the bottom surface 294 thereof. The bore 290 is formed with a diameter so as to receive therein the post 284 of the top block 280. Moreover, a bore 296 is formed laterally through the bottom block 282, from one edge face thereof to an opposite edge face thereof. The lateral bore 296 is formed at a location such that when the post 284 of the top block 280 is inserted into the bore 290 of the bottom block 282, the hole 288 in the post 284 is aligned with the hole 296 in the bottom block 282. The alignment of the holes is shown in FIG. 43, where the top block 280 is shown engaged with the bottom block 282.

FIG. 44 shows a top view of the engaged blocks, with a rope or cable 300 passing through both the aligned bore 296 in the bottom block 282 and the bore 288 in the post 284. The passage through both portions of the top block 280 and bottom block 282 of the cable 300 interlocks the blocks of the set together and prevents removal thereof. Further, the rope 300 can be utilized to install a matrix or mat of laterally interlocked blocks in an underwater location. As noted above, the connectors 50 can be employed to laterally interlock one block set to another block set to thereby prevent rotation of the block sets about the ropes 300. Moreover, by the use of the connectors 50, only a single rope 300 need only pass through each block set. This embodiment of the invention is especially well adapted for installing erosion control blocks in underwater applications.

The installation of a mat or matrix of erosion control blocks in an underwater or other area is generally carried out by the use of a crane. After the erosion control blocks are cabled together, the crane can pick up a section of cabled blocks, hoist them over the water covered area and lower the mat of blocks into place. Scuba-equipped divers can then interlock the edges of one mat to the edges of another, in the event such blocks are of the interlocking type. Traditionally, when a matrix of blocks, whether or not interlocked together, are cabled together and installed, the cable remains with the matrix of blocks and thus is not recovered. Indeed, in many instances the cable itself is necessary to maintain the blocks interlocked together. According to an important feature of the present invention, an erosion control block, or block set, is constructed with a central bore therein for receiving cable apparatus that can be engaged with the block, and thereafter released to recover the cable and associated apparatus. In this manner, the cabling can be recovered and reused, thereby reducing the overall cost of the installation of erosion control blocks in underwater or other applications.

With reference to FIG. 45, there is illustrated a barrel-shaped pneumatic plug 310 for engaging with an erosion control block and for lifting thereof by the use of a cable strung through a closed eyelet hook 312. The pneumatic plug 310 is constructed of an elastomeric or rubber material that is inflatable to increase its diametric size. Such plugs are conventionally available for plugging the ends of newly-installed or repaired utility pipes so that the pipes can be pressurized to test for leaks. Inflatable plugs of such type are available in various sizes, and obtainable from Cherne Industries, Minneapolis, Minn. The inflatable plug 310 includes an elastic body 314 with a number of ribs 316 that encircle the round barrel-shaped body 314. The annular ribs 316 extend radially outwardly from the outer surface of the body 314, thereby assuring a firm grip within a bore 320 of a block set 322 shown in FIG. 46. The inside annular bore 320 of concrete erosion control blocks provides an excellent surface for the gripping thereof by the ribs 316, as well as gripping with much of the body 314 of the pneumatic plug 310. Indeed, pneumatic plugs having an uninflated three inch diameter can be inflated so that the diameter substantially increases, to about double the original dimension. When properly inflated and engaged with a concrete erosion control block, the plugs 310 can provide a sufficient gripping engagement to lift loads up to 200 pounds. Of course, the larger the pneumatic plug, the more load it can lift.

Anchored to the top of the pneumatic plug 310 is the eyebolt 312 fastened within a threaded nut 324. A valve stem 326 of a type similar to that of an automotive inner tube, is attached to or formed integral with the body 314 of the pneumatic plug. Air pressure can be applied to the valve stem 326 to inflate the pneumatic plug 310 and thereby increase the diameter thereof for achieving a gripping engagement within the bore 320 of a block set 322. While the preferred method of installation involves that of a block set 322 interlocked laterally with other neighboring block sets, the inflatable plug 310 can be employed with single blocks that may or may not be interlocked with neighboring blocks. While not shown, the top and bottom blocks of the block set 322 of FIG. 46 are preferably interlocked together, such as with one or more bolts as shown in FIG. 37, an adhesive as shown in FIG. 38, the side engaging locking members shown in FIGS. 39–49, or other techniques or apparatus for engaging the top block to the bottom block. Also, it is contemplated that the block set 322 will be interlocked to adjacent neighboring blocks with the connectors 50 and sockets 30, shown in FIGS. 1–5. With this arrangement, the blocks remain interlocked together as a matrix when installed under water and the cabling is removed. As noted above, divers can install the connectors 50 between the peripheral block sets of a matrix and the peripheral blocks of neighboring block matrices.

Figure 47:
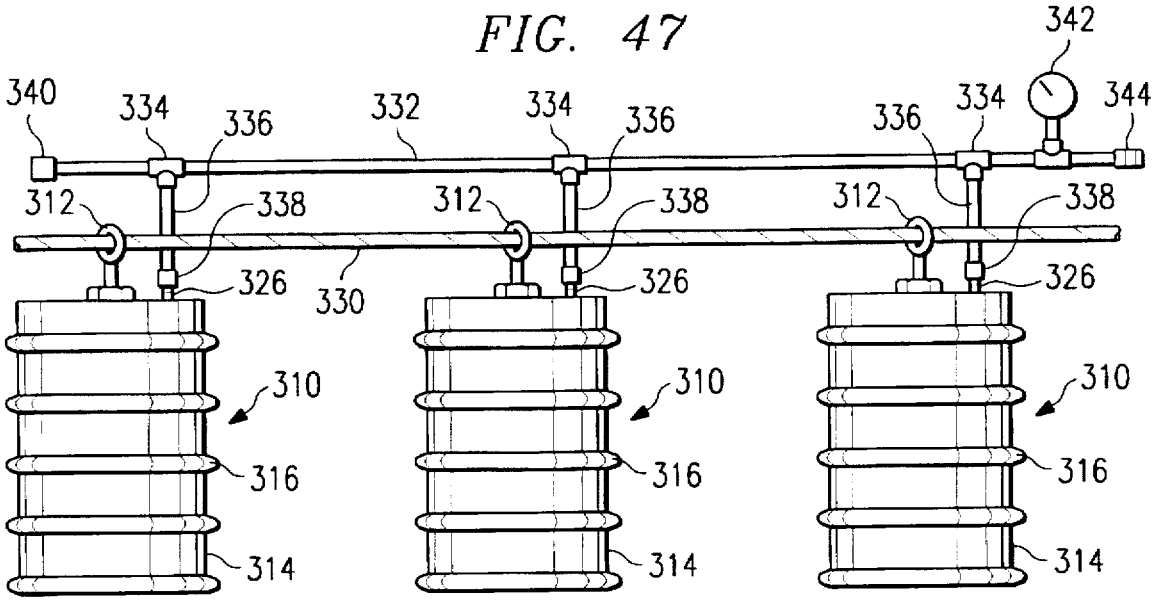
FIG. 47 is a side view of block lifting apparatus equipped with a number of pneumatic plugs suspended by a cable, and with an air hose to uniformly inflate each plug.

In FIG. 47, there is illustrated the block lifting apparatus according to the preferred embodiment of the invention, shown prior to the insertion of the pneumatic plugs 310 into the central annular bores of the erosion control block sets. According to the method of arranging a matrix of block sets together, the bottom blocks of a set are first laid out on a flat surface in a matrix of the size of about 8' wide by 40–60' long. This size facilitates the transportation of the completed matrix of block sets on a semitruck trailer bed to the installation site. The bottom blocks are spaced apart so that the interlocking connectors 50 can be placed into the respective sockets 30. Then, the upper or top blocks are laid on the respective bottom blocks to form a set, and to thereby capture the connectors 50 therein. Each top and bottom block of a set may be locked together by various techniques noted above, or those skilled in the art may choose not to lock the top and bottom blocks together. Next, the pneumatic plugs 310 are inserted into the aligned bores 320 of the top and bottom blocks of a block set 322. The eyelet hooks 312 of the pneumatic plugs 310 are aligned so that a wire rope cable can be conveniently threaded through each of the eye hooks of the plugs 310 in a row. The end of each cable can be fixed in a small loop, or attached to a clevis.

After all of the pneumatic plugs 310 have been inserted into the bores of the respective block sets, an air pressure hose 332 is employed to inflate each row of pneumatic plugs 310. The pressure hose 332 includes a number of "T" connections 334 that include a short, flexible hose 336. At the end of the short hose 336 is a quick-disconnect connector for attaching to the valve stem 326 of the pneumatic plug 310. The connector 338 can be of the conventional type that is lever-operated for attaching to a valve stem, and then for easy release thereof. The end 340 of the air pressure hose 332 is capped by suitable means. As can be appreciated, the air pressure hose 332 is equipped with as many quick-disconnect connectors 338 as there are pneumatic plugs 310. Correspondingly, there may be as many pneumatic plugs 310 in a row as there are erosion control block sets, although the number of plugs 310 need not necessarily equal the number of block sets in a row. It is contemplated that in order to provide a matrix of about 8' by 50', there will be about eight erosion control blocks to provide an 8' width, and about twenty-five erosion control blocks per row to achieve a length of 50'.

The air pressure hose 332 is equipped with a pressure gauge 342 so that the pressure within the hose can be monitored. At the end of the pressure hose 332 there is another quick-disconnect connector 344 that is connected to a source of air pressure (not shown). It is contemplated that air pressures in the neighborhood of 30 psi–50 psi will be adequate for inflating the pneumatic plugs 310 so as to firmly grip with the block sets so that the block sets can be lifted.

Figure 48:
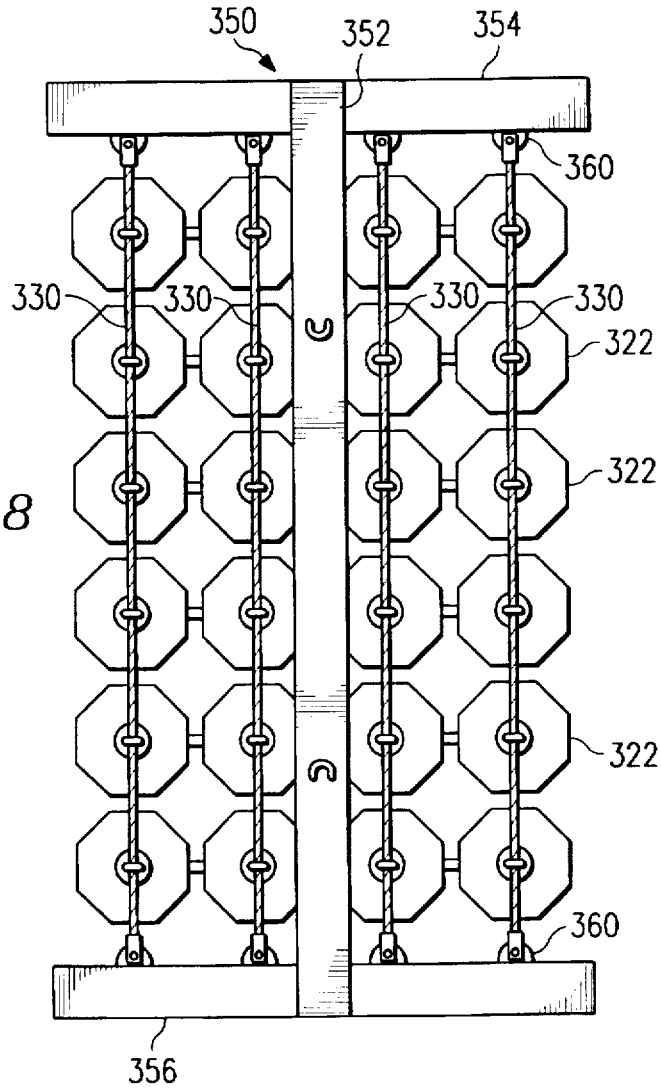
FIG. 48 is a top view of apparatus for lifting a mat or matrix of erosion control blocks with a crane.

After the pneumatic plugs 310 have been suitably inflated so as to firmly grip the respective block sets 322, the quick-disconnect connections 338 are removed from each pneumatic plug 310, and the air pressure hose 332 and associated apparatus is removed. Only the pneumatic plugs 310 remain in the block sets, as cabled together by the wire rope cable 330. FIG. 48 shows a small matrix of block sets 322 with the rows of block sets cabled together with the respective wire rope cables 330. The looped ends of the cables 330 are connected to spaced apart cross member of a spreader bar assembly 350. Groups of cabled block matrices can then be lifted and loaded onto a truck bed and transported to the installation site. One end of each cable 330 can be equipped with a loop or clevis for hooking to a corresponding hook or fastener that is fastened to the cross member of the spreader bar 350.

Figure 49:
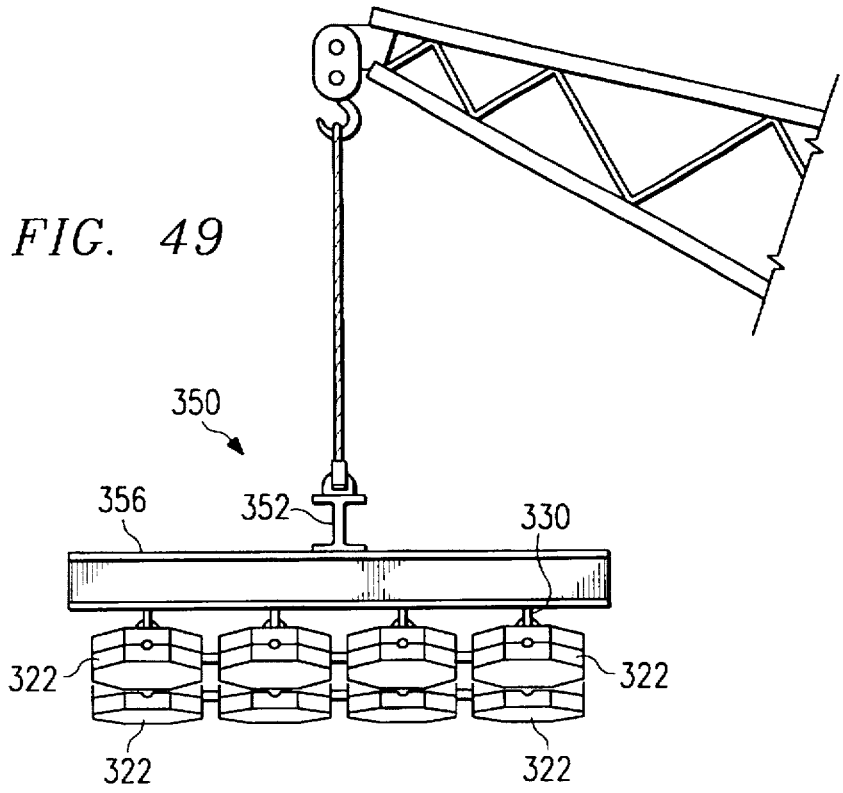
FIG. 49 is an end view of block lifting apparatus of FIG. 48.
Figure 50:
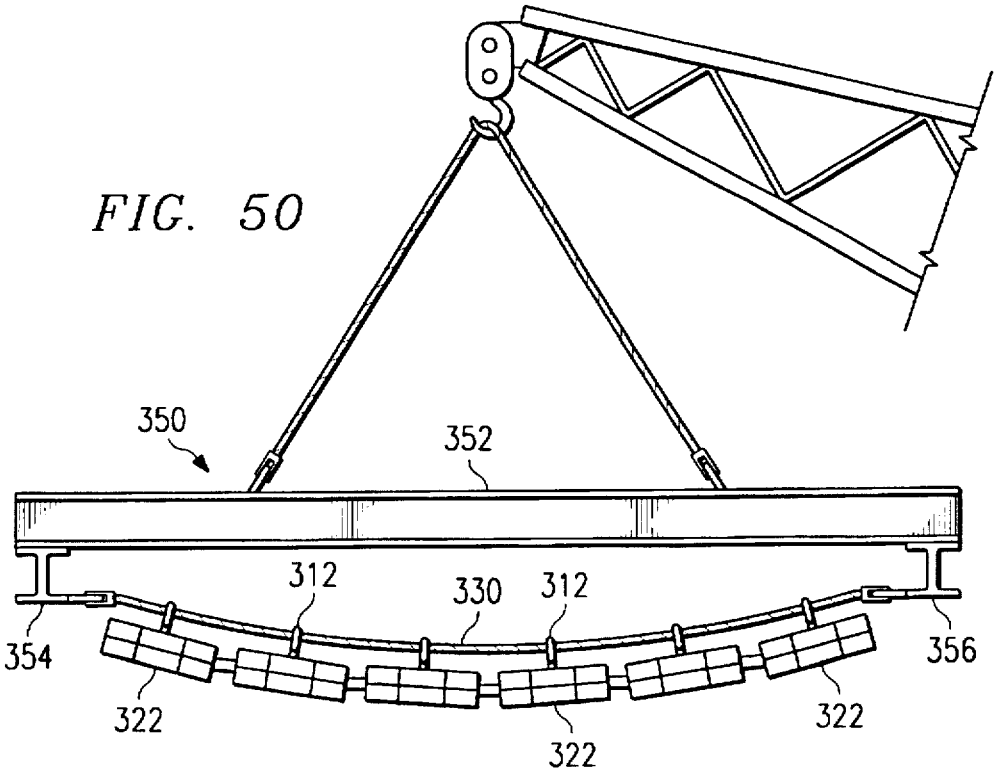
FIG. 50 is a side view of the block lifting apparatus of FIG. 48.

The spreader bar 350 comprises a central beam 352 that is somewhat longer than the length of the matrix of blocks. The beam 352 can be a structural I-beam having sufficient strength to lift the weight of the matrix of blocks. Welded or otherwise attached to each end of the beam 352 are cross members 354 and 356. The lateral length of each support cross member 354 and 356 is at least as wide as the width of the matrix of blocks. The central beam 352 of the spreader bar assembly 350 is attached at the center thereof to a crane or other lifting equipment. At the block installation site, the spreader bar 350 is lowered over the truck bed and centered with respect to the matrix of blocks, as shown in FIG. 48. The looped ends 360 of the cables 330 are then attached to corresponding hooks at the opposite cross members 354 and 356. After each free end ofthe respective cables are attached to the cross members 354 and 356, the spreader bar assembly 350 is lifted by the crane, thereby lifting the matrix of blocks. An end view and side view of a matrix of block sets, as lifted by a crane, are shown in FIGS. 49 and 50. As can be seen, the connectors 50 maintain the neighboring blocks of the matrix interlocked together to prevent separation of the rows of block sets. It is contemplated that the peripheral block sets of the matrix do not have connectors 50 engaged therein, as such connectors will be installed with neighboring matrices after the matrix has been lowered in place at the installation location, adjacent a previously installed matrix.

As can be appreciated, divers or workers can assist the crane operator in accurately aligning the spreader bar 350 so that the matrix of block sets can be accurately lowered and located an appropriate distance from the peripheral blocks of a previously installed matrix. Those skilled in the art may find it advantageous to provide the peripheral blocks of a matrix with the elongate sockets 92 (FIG. 17) so that variations in the lateral distance between the peripheral blocks of the different matrices can be accommodated.

After the matrix of block sets has been interlocked with a neighboring matrix, the divers or workers can manually operate the valve stems 326 of each inflatable plug 310, thereby deflating the plugs. The plugs can then be easily pulled out of the bores 320 of the respective block sets of the entire matrix. When the crane lifts the spreader bar 350, the cables 330 as well as the inflatable plugs 310 are recovered and reusable with another matrix. It is also noted that the inflatable plugs 310 are not easily lost in underwater installation sites, even if they become inadvertently released from the cabling, as such plugs will readily float to the surface and can thereby be recovered. The cabling 330 and associated inflatable plugs 310 attached thereto can be disconnected from the spreader bar 350 and transported on the truck flat bed back to the erosion control block fabricating plant. Those skilled in the art will readily appreciate that by recovering the wire rope cabling 330, the expense in such types of installations of erosion control blocks is reduced accordingly. It can also be appreciated that the installation of an entire matrix of blocks substantially reduces the labor that would otherwise be necessary in manually installing and interlocking each erosion control block with a neighbor block.

As can be appreciated from the description of the invention herein, the erosion control block and method of installation thereof involves principles and concepts that overcome many of the shortcomings and disadvantages of the prior art blocks. Therefore, while the preferred and other embodiments of the methods and apparatus have been disclosed with reference to specific structures, techniques and the like, it is to be understood that many changes in detail may be made as a matter of engineering choices without departing from the spirit and scope of the invention, as defined by the appended claims. Indeed, those skilled in the art may prefer to embody the apparatus in other forms, and in light of the present description, they will find it easy to implement that choice. Also, it is not necessary to adopt all the various advantages and features of the present invention in a single embodiment or assembly in order to realize the individual advantages disclosed herein.

What is claimed is:

1. A method of moving a matrix of erosion control blocks, comprising the steps of:

inserting inflatable plugs in corresponding bores of ones of the erosion control blocks;

inflating the inflatable plugs;

cabling a plurality of the inflatable plugs together;

lifting the matrix of erosion control blocks by the cabling and lowering the matrix to a desired location; and removing the cabling from the matrix and reusing the cabling for another matrix of erosion control blocks.

2. The method of claim 1, further including cabling the blocks together by threading an end of a cable through eyelet hooks attached to the inflatable plugs.

3. The method of claim 1, further including maintaining a mechanical interlock between the blocks of the matrix after the cabling has been removed.

4. The method of claim 1, further including installing the matrix of erosion control blocks at an underwater location.

5. The method of claim 3, further including the step of maintaining the interlock between the blocks so that one block cannot be lifted out of engagement with another block, once the cabling is removed.

6. The method of claim 1, further including deflating each said plug after installation of the matrix and removing the plugs and the cabling from the matrix of blocks.

7. The method of claim 5, further including simultaneously inflating a plurality of said plugs at the same time using a common air pressure hose.

8. The method of claim 1, further including fixing together a separate top portion and bottom portion of each said block by said inflatable plug.

9. The method of claim 1, further including releasably attaching the cabling to said blocks so that when the blocks are installed as a matrix, said cabling is easily released from said blocks.

10. The method of claim 1, further including threading a cable through eyehooks that are removably attached to said blocks in each row of said matrix, and fixing an end of each cable to a lifting beam, whereby said eyehooks remain attached to said cabling during the installation of a plurality of said matrices.

11. A method of moving a matrix of erosion control blocks, comprising the steps of:

arranging a plurality of erosion control blocks in a matrix of a plurality of rows by interlocking the blocks of one row with corresponding blocks of an adjacent row;

inserting an inflatable plug into a respective bore of ones of said blocks in each said row;

inserting a respective cable through an eyehook of a plurality of said inflatable plugs;

inflating each said plug to thereby engage and fix said plugs to the respective erosion control blocks;

lifting the plugs and thus the blocks engaged thereto;

moving the matrix of erosion control blocks to a desired location; and deflating the plugs and removing the plugs from the installed blocks.

12. The method of claim 11, further including the steps of locking together an upper block member with a lower block member so as to form a cavity by said upper and lower block members, and connecting a connector between the cavity of one said block to a cavity of an adjacent said block to thereby interlock the blocks together.

13. The method of claim 11, further including cabling together ones of said blocks in a row, but not cabling together the blocks in different rows.

14. The method of claim 11, further including inserting a cable through an eyehook of each said plug inserted into a respective block of a row of blocks.

15. The method of claim 11, further including inflating and deflating all said plugs in a row substantially simultaneously.

16. A cable and a plurality of inflatable plugs for carrying out the method of claim 11.

17. The method of claim 11, further including inserting an inflatable plug in each erosion control block in a row.

18. The method of claim 11, further including using inflatable plugs having annular ribs for engaging a bore formed in ones of said blocks.

* * * * *